United States Patent [19]

Hanning

[11] 4,112,937

[45] Sep. 12, 1978

[54] GAS OPERATED RECIPROCATING CLEANING AGITATOR

[76] Inventor: Dick M. Hanning, 12092 Pine St., Los Alamitos, Calif. 90720

[21] Appl. No.: 769,878

[22] Filed: Feb. 18, 1977

[51] Int. Cl.[2] ..... B08B 3/04

[52] U.S. Cl. ..... 134/141; 134/164

[58] Field of Search ..... 134/141, 164

[56] References Cited

U.S. PATENT DOCUMENTS

| | | | |
|---|---|---|---|
| 3,269,397 | 8/1966 | Woods | 134/141 |
| 3,794,053 | 2/1974 | Jones | 134/141 |

*Primary Examiner*—Robert L. Bleutge

*Attorney, Agent, or Firm*—Fulwider, Patton, Rieber, Lee & Utecht

[57] ABSTRACT

The apparatus of this invention relates to an agitating device which is to effect cleaning of metallic parts in a cleaning solution with the parts being submerged in a volume of the solution contained within a container. A valve rod is movably mounted within a housing and the valve rod is low frictionally mounted for movement by a spring biased ball bearing assembly. Pressurized air is to be selectively conducted and discharged into a piston chamber. A piston is movably mounted within the piston chamber against the action of a spring. The piston is tightly sealed with respect to the chamber wall.

1 Claim, 7 Drawing Figures

Fig. 1.
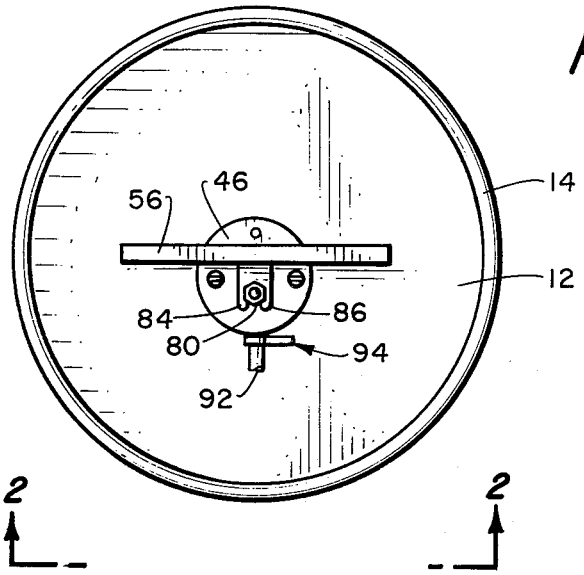
Fig. 2.
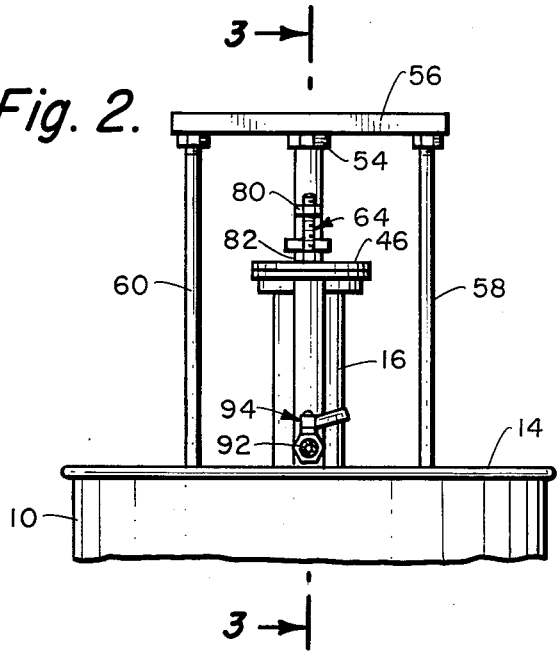
Fig. 3.
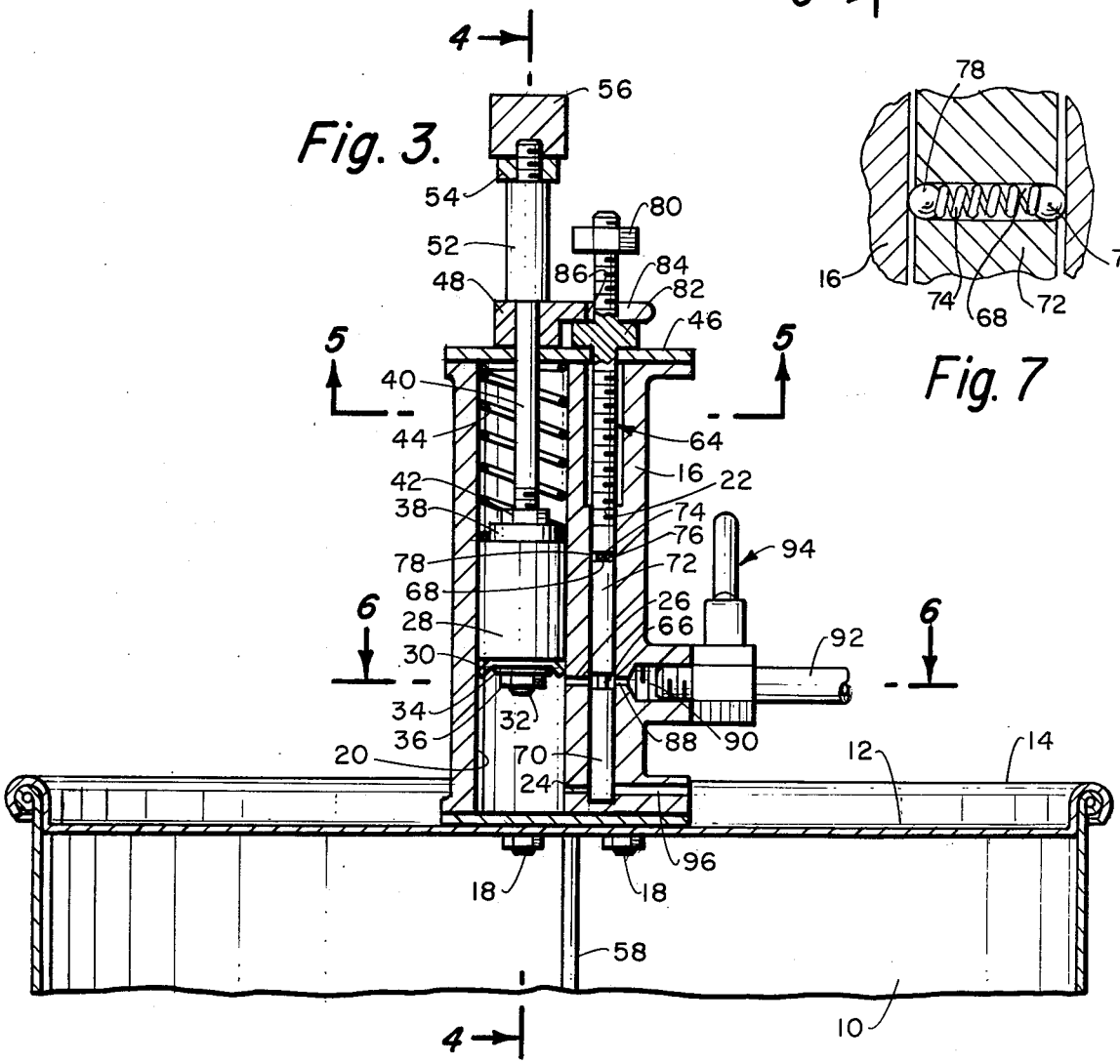
Fig. 7

GAS OPERATED RECIPROCATING CLEANING AGITATOR

BACKGROUND OF THE INVENTION

The field of this invention relates in general to a cleaning apparatus, and more particularly to a cleaning agitator designed to immerse articles to be cleaned into a container containing a cleaning liquid. The structure of this invention is particularly adapted to the cleaning of irregularly shaped metallic articles, such as carburetors and other engine parts by placing the same within a basket or other article supporting means and locating the same within the cleaning fluid within the container and then causing the basket to reciprocate rapidly. This is accomplished by connecting the device to a source of pressurized gas, such as air.

The device of this invention is an improvement of the device defined within U.S. Pat. No. 3,269,397, issued Aug. 30, 1966.

SUMMARY OF THE INVENTION

The basic apparatus of this invention is shown and described within the aforementioned U.S. Patent. Basically, the form of this apparatus comprises a container upon which a lid is adapted to be located. Fixedly mounted upon the lid is a housing which includes a piston receiving chamber and a valve receiving chamber. Air pressure is to be conductable into the housing to the valve receiving chamber and with the valve in the lower position is capable of being conducted into the piston receiving chamber. A piston is movably mounted within the piston receiving chamber and is spring biased to the lower position with the pressurized air being supplied into the piston receiving chamber, the piston is driven upwardly against the action of the spring until a member mounted upon the piston rod causes movement in the upward direction of the valve member mounted within the valve receiving chamber. At this time, the pressurized air is no longer supplied into the piston receiving chamber and then an outlet is then provided for the pressurized air within the air receiving chamber which is quickly conducted into the ambient through an outlet passage arrangement. At this time, the piston then falls which forces the above-mentioned piston rod-mounted member to cause the valve member to also fall thereby closing the outlet passage assembly and reopening the inlet passage assembly and permitting pressurized air to be resupplied to the piston chamber. The piston rod is connected to a basket which is supported within the container and is movable reciprocally therein. The valve member is low frictionally mounted through a spring biased bearing assembly to prevent the valve member from falling until engaged by the piston rod-mounted member.

The primary object of this invention is to provide a simple cleaning device wherein a reciprocating motion is transmitted to an article supporting means which is supported within a volume of cleaning fluid which results in extremely efficient cleaning of any articles located within the article supporting means.

The specific objectives of the apparatus of this invention is that by the constructing of the device of this invention extremely rapid reciprocating motion occurs which effects efficient cleaning of articles to be cleaned in a short period of time.

BRIEF DESCRIPTION OF THE DRAWINGS

FIG. 1 is a plan view of the agitator apparatus of this invention;

FIG. 2 is a side view of the agitator apparatus of this invention just showing only the top portion of the container taken along line 2—2 of FIG. 1;

FIG. 3 is a cross-sectional view taken along line 3—3 of FIG. 2;

FIG. 7 is an enlarged view of a portion of the valve rod of the invention.

DETAILED DESCRIPTION OF THE SHOWN EMBODIMENT

Figure 4:
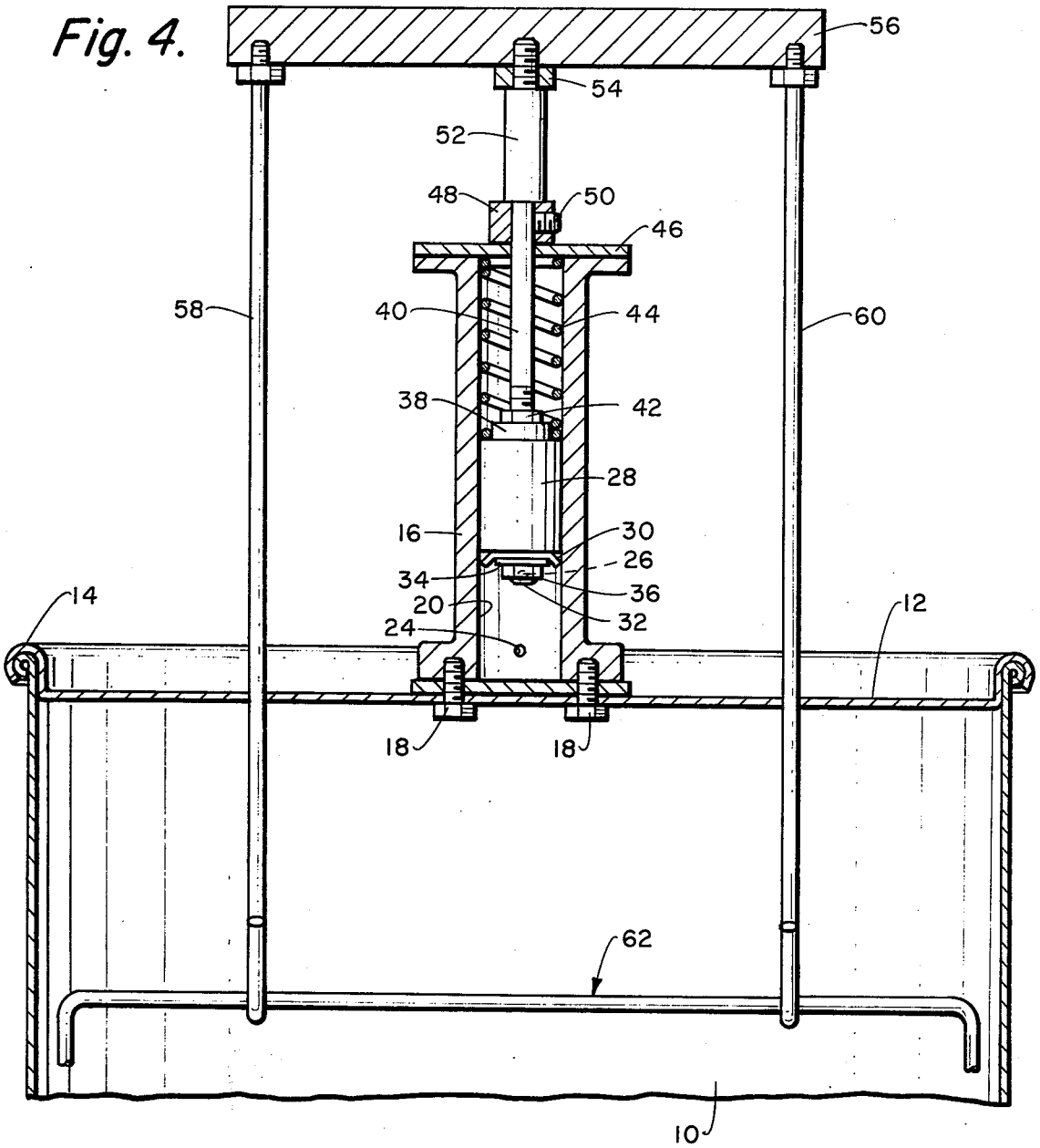
FIG. 4 is a cross-sectional view taken along line 4—4 of FIG. 3.
Figure 5:
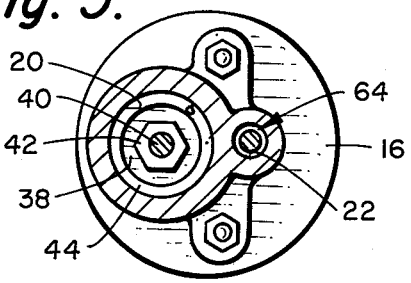
FIG. 5 is a cross-sectional view taken along line 5—5 of FIG. 3.
Figure 6:
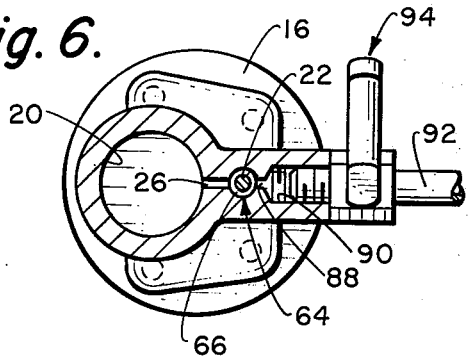
FIG. 6 is a cross-sectional view taken along line 6—6 of FIG. 3.

Referring particularly to the drawings, there is shown a container 10 which cooperates with a lid 12 which is attached to the container 10 by a flexible annular bead 14. A housing 16 is fixedly mounted in the center of the lid 12 by means of screw fasteners 18.

Within the housing 16 are located a pair of elongated cylindrical chambers, the piston receiving chamber 20 and the valve member receiving chamber 22. Adjacent the bottom of the chamber 20 is located a gas outlet passage 24. Located a predetermined distance above the passage 24 is a gas inlet passage 26.

Movably mounted in a close fitting relationship within the chamber 20 is a piston 28. Attached to the outer end of the piston 28 is a cup shaped flexible washer 30 which is normally constructed of a leather material. The washer 30 is fastened to the end of the piston 28 by means of a washer 34 and a nut 36 which is threadably secured upon a threaded member 32 which is secured to the piston 28. By the using of the leather washer 30, a substantially air tight connection is established between the piston 28 and the chamber 20 as the piston 28 is moved therein.

Integrally formed on the upper surface of the piston 28 is a smaller diametered section which is to function as a spring retainer 38. A piston rod 40 is threadably secured to the spring retainer 38 and is fixed with respect thereto by means of a nut 42. A coil compression spring 44 is located within the chamber 20 with one end of the spring 44 in contact with the upper surface of the piston 28 and located about the spring retainer 38 and the other end of the spring 44 in contact with housing cover 46. The housing cover 46 closes the chamber 20 and is fixedly secured to the housing 16.

The piston rod 40 is slidably mounted through an appropriate opening formed within the cover 46 and extends exteriorly thereof. A collar 48 is fixedly secured to the rod 40 by means of a set screw 50. The rod 40 is conducted through an opening within the collar 48 and extends through a spacer 52. The spacer 52 may be integrally formed with the rod 40 or may be separate and fixedly secured thereto by means of being threadably attached upon the rod 40. Adjacent to the spacer 52 is a nut 54 which is threadably secured to the rod 40. The rod 40 is then threadably secured to a cross bar 56.

On one end of the cross bar 56 is threadably secured a first supporting rod 58 with a second supporting rod 60 being fixedly secured to the cross bar 56 at the other end thereof. The supporting rods 58 and 60 extend through appropriate openings formed within the lid 12 and are slidably movable in respect thereto. Each of the supporting rods 58 and 60 terminate in an upstanding hook portion which is connected to a wire basket member 62, only the upper portion of which is shown in FIG. 4 of the drawings.

A valve rod 64 is movably mounted within the chamber 22. Adjacent the lower end of the rod 64 is an annular groove 66. The annular groove 66 divides the rod 64 into a lower land and an upper land 72. Within the upper land 72 there is formed a transverse opening 68. Within the transverse opening 68 is located a small coil spring 74. Each end of the small coil spring 74 cooperates with a small sized ball bearings 76 and 78. The spring 74 functions to bias the coil springs 76 and 78 out against each side of the chamber 22. FIG. 7 illustrates in detail the biasing arrangement associated with the transverse opening 68. The ends of the opening 68 are slightly crimped inwardly so that the bearings 76 and 78 only slightly protrude exteriorly of the surface of the land 72. Through the use of the spring 74 and the bearings 76 and 78, the rod 64 is centered within the chamber 22 and has a very slight amount of clearance that is constantly maintained thereby minimizing frictional drag. In other words, through the use of the bearings 76 and 78 the rod 64 moves quite freely within the chamber 22 but exerts a slight frictional drag on the rod.

The upper end of the rod 64 is threaded and cooperates at its other end thereof with a nut 80. Adjacent to the nut 80 but spaced therefrom is a flange 82 which is integral with the rod 64. The collar 48 includes a bifurcated extension 84 which includes a U-shaped recess 86. Through the U-shaped recess 86 is conducted the rod 64. In the at rest position of the device of this invention, the flange 82 rests against the cover 46 with the extension 84 resting against the flange 82 (FIG. 3).

Extending through the side wall of the housing 16 is located a gas passage 88. This gas passage 88 connects with an enlarged opening 90 which is to threadably connect to a conduit 92. A simple on and off valve 94 is connected at the interconnection of conduit 92 with the passage 90 which is to selectively to supply pressurized gas from conduit 92 to passage 88 or not supply when the device is not operating. In the position shown in FIG. 3 of the drawings, the gas passage 88 connects with the annular groove 66 which, in turn, connects with the gas passage 26.

The outlet passage 24 connects with a second outlet passage 96 within the outer portion of the housing 16. In the position shown in FIG. 3 of the drawings, there is no communication between the passages 24 due to the fact that land 70 blocks the passage of gas therebetween. It is to be noted that the diameter of the passage 96 is substantially larger than the diameter of the passage 24. This has been found to be particularly desirable for rapid expelling of gas into the ambient from the chamber 20 when it is desired to expel the gas from the chamber 20 which will become apparent further on in the specification. In the operation of the device of this invention, when it is desired to insert pressurized air to within the chamber 20, it is desired to do so very rapidly with a minimum amount of leakage. When it is desired to remove the pressurized gas from the chamber 20, it is desirable to do this as rapidly as possible. It is this type of rapid accomplishing of the function that creates the significantly more cycles per minute of operation than was possible with the prior art apparatus.

In the operation of the agitating structure of this invention, it will be presumed that the basket 62 is loaded with one or more parts to be cleaned within a fluid contained within the container 10. The lid 12 is placed upon the container 10 and the annular bead 14 locked upon the upper portion of the container 10. Pressurized gas is supplied from a source (not shown) to within the conduit 92. The operator then operates the valve structure 94 to permit the gas to be conducted from the conduit 92 to within the chamber 90 through the passage 88 and into the annular groove 66. From the annular groove 66 the gas passes through the passage 26 to within the lower end of the chamber 20.

The pressurized gas within the chamber 20 causes the piston 28 to move upwardly rapidly against the action of the spring 44, compressing the spring 44. After a certain amount of lost motion the extension 84 will come into contact with nut 80 and the valve member 64 will then proceed to move upwardly within the chamber 22. Only after a slight amount of upward movement, the groove 66 becomes disassociated from the passages 88 and 26 and the land 70 comes therebetween and blocks the conducting of pressurized gas to within the chamber 20. At this particular time, the lower portion of the land 70 is moved above the passages 96 and 24 which will permit the pressurized gas within the lower end of the chamber 20 to be conducted into the ambient through the chambers 24 and 96. Since the pressurization of the chamber 20 is being rapidly lost, the piston 28 is permitted to fall downwardly by gravity. This downward movement of the piston 28 is also accentuated through the bias of the spring 44. At this particular time, extension 84 of collar 48 engages rod flange 82 (see FIG. 3) to thereby urge the valve rod 64 to move downwardly which then prevents further escape of pressurized gas from the chamber 20 and then repermits the supply of pressurized gas into the chamber 20. The procedure is then repeated.

Through the use of the spring 44 and the bearing assembly 76 and 78 and the differential size between the passages 24 and 96, the structure of this invention achieves substantially more number of cycles per minute as does the device of the aforementioned patent.

What is claimed is:

1. In a cleaning fluid agitator provided with a container having an interior fluid chamber, a lid for said container adapted to close said container and permit access into said fluid chamber and a cross-bar from which depends a pair of supporting rods that slidably extend through said lid and support a wire basket for supporting articles within said fluid chamber, an actuator to impart rapid reciprocating motion to said cross-bar, said actuator comprising:

a housing fixedly mounted upon said lid, a first chamber formed within said housing, a second chamber formed within said housing, said second chamber being spaced from said first chamber; and both of said first and second chambers are arranged in total isolation from said fluid chamber;

a piston reciprocably movably located in said first chamber and movable between a lower position and an upper position, said piston having a piston rod that extends upwardly through said housing, with the upper end of said piston being attached to said cross-bar;

a coil spring located in said first chamber constantly biasing said piston towards said lower position;

an elongated valve member reciprocably movably located within said second chamber and divided into upper and lower lands by an annular groove and a transverse opening is defined within said upper land and is slightly crimped at both ends;

a collar on said piston rod that engages vertically spaced nuts on said valve member after a predetermined amount of vertical movement of said piston towards said lower and upper positions to cause said valve member to move in synchronism with said piston;

a pair of ball bearings carried by said valve member and which are carried in said transverse opening in said upper land and are spring biased into the wall of said second chamber and are allowed to protrude only slightly exteriorally of said upper land, thereby precisely and continuously centering said valve member within said second chamber while exerting only rolling frictional drag on said valve member as it reciprocates within said second chamber.

a gas inlet passage assembly formed in said housing extending between a pressurized gas source and said second chamber and said first chamber for admitting pressurized gas into the latter to effect upward movement of said piston;

a gas outlet passage assembly formed in said housing below said gas inlet passage assembly, said gas outlet passage assembly including a horizontal inner outlet passage connecting said first and second chambers and a horizontal outer outlet passage connecting said second chamber directly with the atmosphere, said inner outlet passage being substantially smaller in cross sectional area than the cross sectional area of said outer outlet passage;

a cup shaped flexible washer fastened to the lower extremity of said piston above said gas inlet passage and disposed to face downward within said first chamber to form a substantially air tight and low friction seal between said piston and said first chamber;

with said piston and said valve member being so configured that when said piston is in said lower position pressurized gas is conducted through said inlet passage assembly into said first chamber and said gas is not capable of being conducted through said outlet passage assembly, and when said piston is in said upper position pressurized gas is not capable of being conducted through said inlet passage assembly but is conductable through said outlet passage assembly.

* * * * *